US007900299B2

(12) United States Patent
Weedling et al.

(10) Patent No.: US 7,900,299 B2
(45) Date of Patent: Mar. 8, 2011

(54) PATIENT TRANSFER DEVICE HAVING INFLATABLE AIR MATTRESS

(76) Inventors: Robert E. Weedling, Center Valley, PA (US); James E. Weedling, Center Valley, PA (US)

( * ) Notice: Subject to any disclaimer, the term of this patent is extended or adjusted under 35 U.S.C. 154(b) by 1402 days.

(21) Appl. No.: 10/143,139

(22) Filed: May 10, 2002

(65) Prior Publication Data

US 2002/0166168 A1 Nov. 14, 2002

Related U.S. Application Data

(60) Provisional application No. 60/290,413, filed on May 11, 2001.

(51) Int. Cl.
*A61G 7/10* (2006.01)

(52) U.S. Cl. ..... 5/81.1 R; 5/81.1 T; 5/625; 5/706

(58) Field of Classification Search ..... 5/81.1 R, 5/81.1 T, 625–628, 691, 413, 491, 706; 128/869
See application file for complete search history.

(56) References Cited

U.S. PATENT DOCUMENTS 4,301,791 A * 11/1981 Franco, III ..... 602/19
4,528,704 A 7/1985 Wegener et al.
4,627,426 A 12/1986 Wegener et al.
4,631,767 A * 12/1986 Carr et al. ..... 5/714
4,686,719 A * 8/1987 Johnson et al. ..... 5/81.1 R
4,876,756 A * 10/1989 Vaccaro ..... 5/710
5,018,226 A * 5/1991 Davies et al. ..... 5/81.1 R
5,065,464 A * 11/1991 Blanchard et al. ..... 5/81.1 R
5,150,487 A * 9/1992 Hemphill ..... 5/625
5,249,318 A 10/1993 Loadsman
5,483,709 A * 1/1996 Foster et al. ..... 5/81.1 R
RE35,299 E 7/1996 Weedling et al.
5,561,873 A * 10/1996 Weedling ..... 5/713
6,073,291 A 6/2000 Davis
6,138,306 A * 10/2000 Muhanna ..... 5/706
6,240,584 B1 6/2001 Perez et al.
2001/0023512 A1 9/2001 Perez et al.

* cited by examiner

*Primary Examiner* — Fredrick Conley
(74) *Attorney, Agent, or Firm* — Drinker Biddle & Reath LLP

(57) ABSTRACT

A patient transfer device comprising at least one inflatable mattress which in turn may comprise one or more inflatable pads. The inflatable mattress includes a plurality of fasteners for attaching an accessory across a top surface of the mattress. The types of accessories that may be attached to the mattress include various types of covers, flexible body litters having carry handles, cushions, other inflatable and non-inflatable mattresses, and garments and wraps for moving the patient together with the device and for making the device capable of being attached to or worn by a patient.

24 Claims, 15 Drawing Sheets

PATIENT TRANSFER DEVICE HAVING INFLATABLE AIR MATTRESS

PRIORITY DATA

This application claims priority from U.S. provisional application No. 60/290,413, filed May 11, 2001.

TECHNICAL FIELD

This application is directed to the general field of inflatable air mattresses used for medical purposes, and to the more specific field of transfer mattresses used to transfer patients from one lateral surface to another. A transfer mattress is one in which a low pressure air source is connected to a mattress with a pattern of small, closely spaced pinholes in the bottom sheet to allow air to escape, forming a film of air between the patient and underlying surface that reduces friction and permits a safe and nearly effortless transfer from one surface to another, such as from a bed to a stretcher or chair or procedure table.

BACKGROUND OF THE INVENTION

The most prevalently produced transfer mattresses at the current time have an array of laterally extending chambers arranged in a generally rectangular pattern in the center of the mattress, with a continuous, rectangular outer chamber extending around the periphery of the mattress. Several embodiments of this type are shown in U.S. Pat. No. 5,561,873. The top sheet of these transfer mattresses is usually a twill weave nylon fabric coated on one side with urethane to make it vapor permeable but waterproof.

Although these mattresses can be cleaned and disinfected after use with various germicidal cleaning solutions, it is preferable to keep the mattress surfaces protected from contact with infectious or contaminating body fluids. This has been accomplished in prior art air mattresses by providing a sanitary sheet, essentially identical to the top sheet of the mattress, which is folded and inserted in a pouch at the foot end of the mattress. This sheet, referred to as a "sani-liner", is intended to be removed from the pouch and laid over the top sheet of the deflated mattress before the patient is placed upon the mattress. When the mattress is then inflated, the sani-liner sheet protects the top surface of the mattress from potentially infectious material. The sani-liner can later be cleaned and disinfected, folded and returned to the pouch.

In practice, however, when hospital workers sometimes need to use the transfer mattress quickly, they do not always take time to remove the sani-liner from the pouch and cover the top sheet. Furthermore, when the sani-liner is removed or otherwise comes detached, it is often lost and not replaced. Thus, it would helpful to have a removable sanitary cover that is already in place over the top sheet when the mattress is deflated and stored, and that can be removed and cleaned or replaced with another cover after use. Consistent with the above, it would be useful to have a transfer mattress that includes fasteners for attaching various accessories, including sanitary covers, to the mattress.

It would also be useful to have a sectional air mattress comprising at least one inflatable transfer pad, with accessories to facilitate convenient repositioning of a patient in a bed, or to improve the ease of transferring a patient from a bed to a chair and vice versa.

SUMMARY OF THE INVENTION

One aspect of the invention is a transfer mattress that includes fasteners for attaching various accessories. The accessories that attach to the transfer mattress may be, for example, a cover sheet, an absorbent cover sheet, a flexible body litter with carry handles, an inflatable air mattress, a cushion, a therapeutic pad, or regular bed-type or patient mattress. The various cover sheets may be a sheet of sani-liner nylon, disposable fabric, or other material commonly used where patient skin breakdown is a concern, having a similar shape to the top sheet of the transfer mattress. It is preferred that the cover sheet be slightly longer and wider than the top sheet. This oversize margin allows the sheet to be drawn over the convex surfaces of the air chambers and to overlap along the sides of the transfer mattress when it is inflated.

The cover sheets and other accessories may be coupled to the transfer mattress at various locations to prevent the cover or accessory from gathering under the patient in order avoid skin breakdown from folds or wrinkles between the accessory and underlying surface. This can be accomplished by snap fasteners attached to the top sheet and mating snap fasteners at the corresponding points of the accessory. Other means of attachment may be substituted for the snap fasteners.

Another aspect of the invention is to provide means to attach the mattress to the underlying surface (such as stretchers or beds) at various placements to restrict longitudinal or lateral movement of the patient in the event it becomes necessary to place the patient in a position other than horizontal.

Another aspect of the invention is to use an accessory with a transfer mattress in which the head and foot end air chambers and/or the right and left side longitudinal chambers are higher than the lateral chambers under the patient. These pontoon-like peripheral chambers can be higher on the top side, bottom side, or both top and bottom sides of the transfer mattress. The height and spacing of air chamber partitions can be used to provide anti-ballooning features. This configuration will provide increased rotational stability and make it easier to move the mattress due to increased support, anti hot-dogging and better air dispersion. This configuration can be used with inflatable mattresses, or with transfer mattresses having small air holes in the bottom sheets and a low pressure air supply.

The accessory is placed on a transfer mattress, preferably under any body straps, and is removeably attached to the mattress. The accessory may also be fixedly attached to the transfer mattress. The selected accessory may also be constructed together with the transfer mattress, as a single unit. The mattress can be folded or rolled into a stored configuration. When needed, it can be unfolded and placed under the patient with the accessory already between the patient and the top sheet. After use, the accessory can be removed, cleaned or a clean accessory can be reattached to the mattress before the next use. Any fabric that is used where skin breakdown is a concern can be used for the accessory.

Another aspect of the invention is to use a transfer mattress as an overlay on a patient mattress. The means to easily attach and detach the transfer mattress from the patient mattress restricts the transfer mattress from movement off of the patient mattress.

Another aspect is to have an inflatable mattress configured as a static, inflatable, non-capillary closing, chambered pad, placed either under or on top of a transfer mattress having a bottom sheet with a pattern of tiny holes to allow the escape of air supplied into the mattress, creating a weight bearing cushion. This embodiment has means to attach or detach the transfer mattress to the static chambered pad. It also has means to rapidly deflate the static pad when necessary.

Another aspect is to provide a removable protective coverlet that prevents the underlying mattress and/or accessory from being contaminated and having means to prevent the coverlet from detachment from the mattress. This provides a convenient transfer mattress that a patient can remain upon while in bed. This would keep the transfer mattress clean and eliminate the necessity of log rolling a patient to place the transfer mattress under him. This would be especially useful in critical care and longer term acute care conditions, such as oncology, burn, ICU, CCU, and the like. This coverlet can also be placed on a three sheet mattress with static chambers providing therapy, and other chambers having the transfer capability.

Another aspect is to use the snap openings for attaching the coverlet as a deflating means by simply detaching the accessory from the transfer mattress or inflatable mattress. This embodiment may also include incorporating a valve into these snap openings, or elsewhere on the inflatable mattress, to set the capillary closure pressure. As an example, a mushroom type valve in a snap opening or on the inflatable mattress air plenum that would close upon reaching the desired internal pressure, using the patient's own weight to regulate the pressure.

Another aspect is a sectioned mattress comprising two or more mattresses or pads, with the sections being detachable from each other and at least one section being a transfer mattress. This could be designed to enable the removal of sections after repositioning the patient. A patient who has slipped toward the foot end of the bed causes a great potential for injury to hospital staff. The difficulty is that when a patient is on a full size unitary mattress and slips toward the foot end of the bed, the pad must be repositioned under the patient. This multi-section design would incorporate means to detach sections of the mattress minimizing the need to reposition the mattress beneath the patient. Generally a patient would be on the lower half of the mattress. Inflating a full size unitary mattress with the patient in this position would result in the head end portion of the mattress being above the patient after repositioning, causing the need to log-roll the patient and properly relocate the mattress. The sectioned mattress would provide the means to remove the portions outside the patient and re-attach them under the patient.

This could be accomplished by having these sections capable of receiving air infusion in each separate section. Thus, if a patient is toward the foot end of the bed (the lower section), that end could be inflated and become the head section after repositioning. The previous head section can be easily removed after deflating and replaced beneath the patient's lower body with minimal patient adjustment and medical staff exertion that might produce muscle strain.

This sectioned concept would also have use in other medical circumstances such as operating room, ambulance, radiology and emergency department applications.

This sectioned mattress also lends itself to the development of a bed to chair/wheelchair application by a sectioned transfer pad incorporating means to attach the sections to the body torso. Releasing low pressure air through sections under the body torso provides for an easier transfer to and from bed to other desired locations. This permits the patient to be transferred safely even when they are not laying flat.

Another aspect would be a sectioned mattress comprising at least one transfer mattress, the sections be adapted to conform to the cushions of a chair.

BRIEF DESCRIPTION OF THE DRAWINGS

For the purpose of illustrating the invention, there is shown in the drawings a form which is presently preferred; it being understood, however, that this invention is not limited to the precise arrangements shown.

DETAILED DESCRIPTION OF THE DRAWINGS

Figure 1:
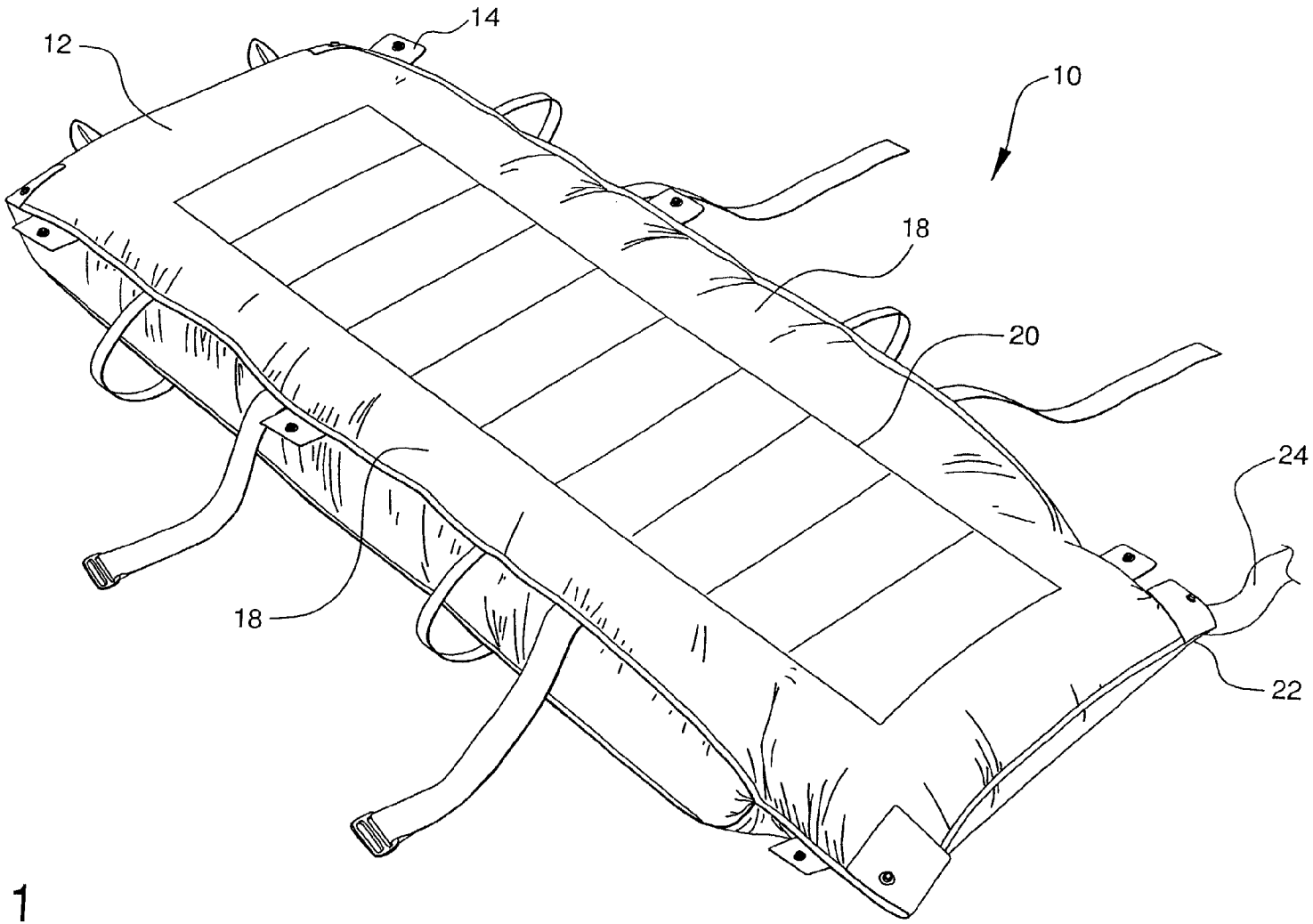
FIG. 1 is a perspective view of a patient transfer device, in accordance with an embodiment of the invention.

Referring now to the figures, there is shown in FIG. 1 one embodiment of patient transfer device 10. The patient transfer device 10 comprises at least one transfer mattress 12 and a plurality of fasteners 14 for attaching an accessory across a top surface of the mattress 12. The mattress 12 may include a generally rectangular array of transverse air chambers 16 supported at each longitudinal side thereof by a longitudinally-extending side air chamber 18. The transition between the transverse chambers 16 and side chambers 18 defining a seam 20 at each longitudinal side of the array.

The fasteners may be any type of fastener capable of attaching an accessory to the mattress 12 and the type of fastener may vary depending on the type of accessory. The fasteners may also be located anywhere on the mattress 12 or attached to the mattress 12 in any manner suitable in light of the accessory. In the embodiment depicted in FIG. 1, the fasteners are mounted on tabs attached to the longitudinally-extending side air chambers.

In FIG. 1, an inlet 22 for inflating the mattress 12 may be a closable opening wherein an air supply hose 24 is inserted and the inlet is snapped shut or otherwise closed to hold the hose in place while the mattress is being inflated. The inlet 22 may also include a valve biased to be normally closed to prevent air from exiting through the inlet and opened when the hose 24 is inserted into the inlet 22. Other arrangements known to those skilled in the art may be used to inflate the mattress 12.

The various types of accessories that may be attached to a transfer mattress are generally unlimited. By way of example, some preferred accessories include various types of covers, such as a non-absorbent sanitary cover, a washable absorbent cover or a disposable cover. Another useful accessory is a flexible body litter with carry handles. Other possible accessories include a wrap for wrapping around a patient or a garment worn by the patient to assist in moving the patient together with the transfer device; a cushion; an inflatable air mattress with a pressure control valve; an inflatable air mattress with pulsating pressure control; a non-inflatable mattress; and a therapeutic pad.

In an embodiment where the selected accessory is a cushion, the cushion may be releasably attached to the inflatable mattress or the cushion and mattress may be constructed as a single unit.

In embodiments where there is an inflatable air mattress, a top surface of the inflatable mattress may be inclined so that the head of a patient lying horizontally on the mattress is at a higher point with respect to a supporting surface than the feet.

Figure 2:
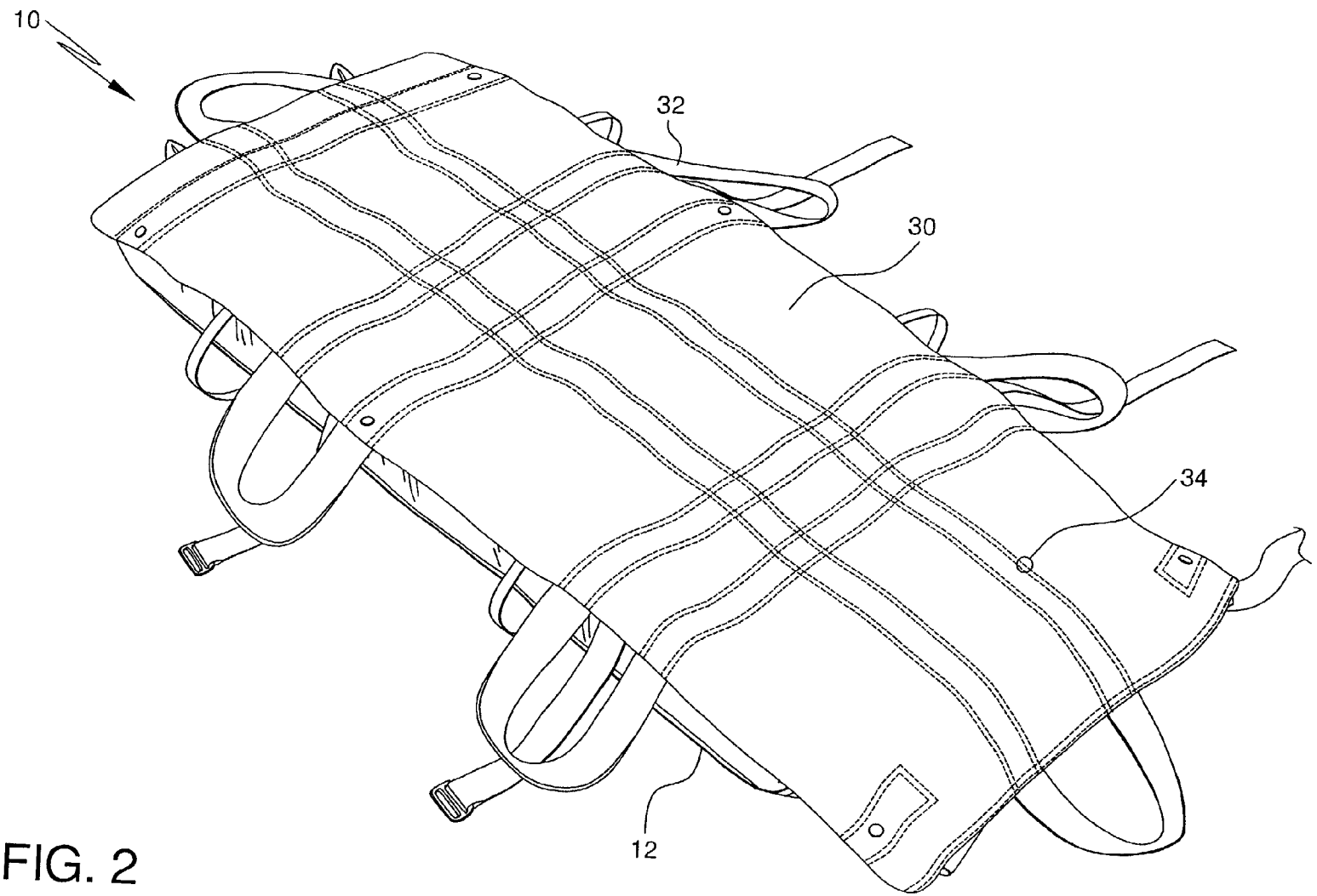
FIG. 2 is a perspective view of a patient transfer device comprising a body litter attached to a top surface of a transfer mattress adapted for transferring a patient from one surface to another, in accordance with an embodiment of the invention.

Referring now to FIG. 2, the patient transfer device 10 is shown with an accessory attached. The accessory is a body litter 30 having carry handles 32. The carry handles are a loop of fabric sewn to the litter 30 as shown by the stitching 34 running between each pair of handles 32. The loop is preferably continuous as shown. In a preferred embodiment, at least two pair of carry-handles extend outward from the mattress. In the depicted embodiment, there are three pairs of carry handles 32, two at the sides and one at each end.

Figure 2A:
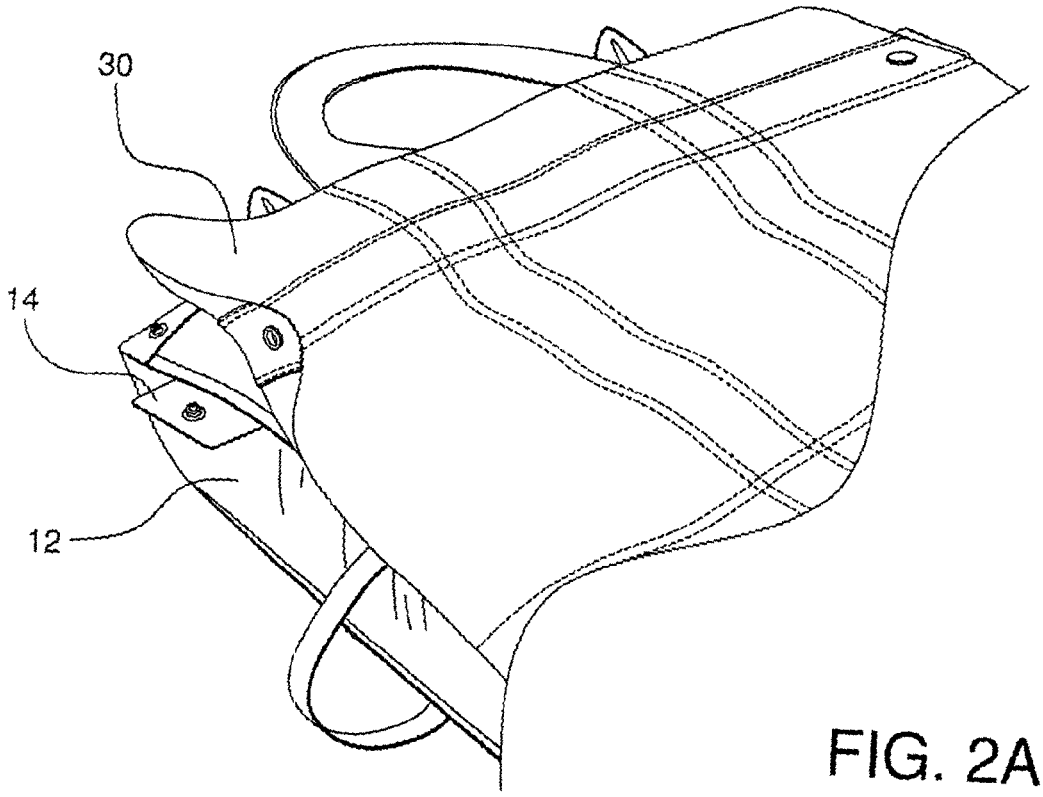
FIG. 2A is a partial view of the patient transfer device shown in FIG. 2 wherein at a corner of the device the body litter is partially removed, in accordance with an embodiment of the invention.

The body litter 30, or any other accessory, may be attached to the transfer mattress 12 using any type of fastener or suitable means of fastening. The selected accessory and mattress may alternatively be fixedly attached or otherwise constructed as a single unit. In FIG. 2A, the fastener is a snap fastener. As shown in FIG. 2A, the tabs 14 have snaps which can attach to snaps located at corresponding positions on the body litter 30, or any accessory. The fasteners 14 may be located outboard of the seams defined by the transition between the transverse chambers and the side chambers. The fasteners may also be mounted on tabs attached to the longitudinally-extending side air chambers, as shown in FIG. 1.

Figure 2B:
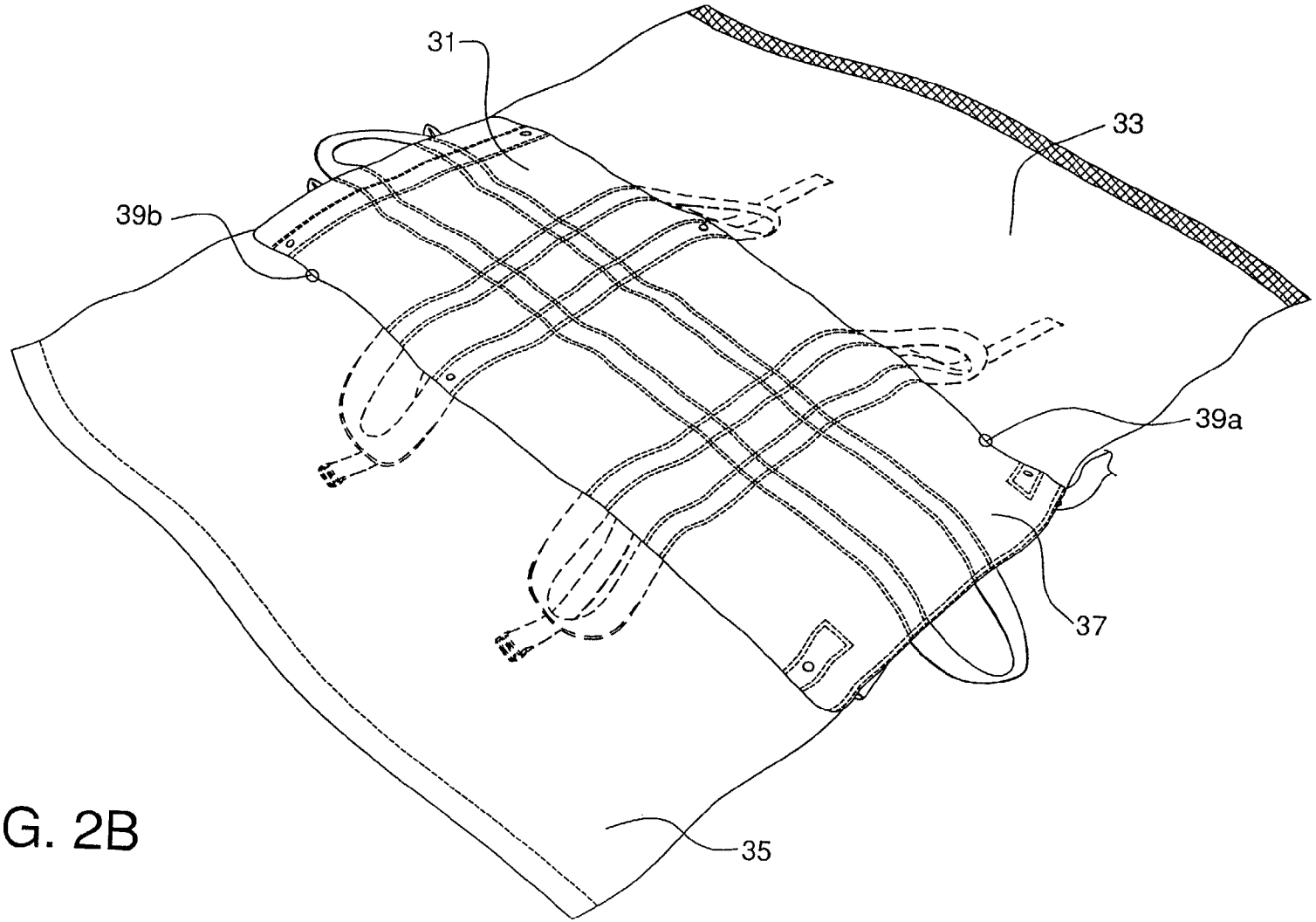
FIG. 2B is a perspective view of a patient transfer device comprising a body litter having flaps, in accordance with an embodiment of the invention.

A preferred body litter 31 is shown in FIG. 2B. The body litter 31 depicted in FIG. 2B includes flaps 33, 35 that extend outward from each side of the body litter 31. When not in use, flap 33 may be folded over the litter's center panel 37 along line 39*a*. Similarly, flap 35 may be folded over the litter's center panel along line 39*b*. If a patient laying on the transfer device is pronounced dead or if a body needs to be transferred, the flaps 33, 35 may be opened as shown in FIG. 2B allowing the body to be covered and transported using one or more pair of carry handles that are preferably attached to the litter's center panel 37. The flaps 33, 35 may also be thermally coated and used to warm patients in shock or who otherwise need to be warmed.

Figure 3:
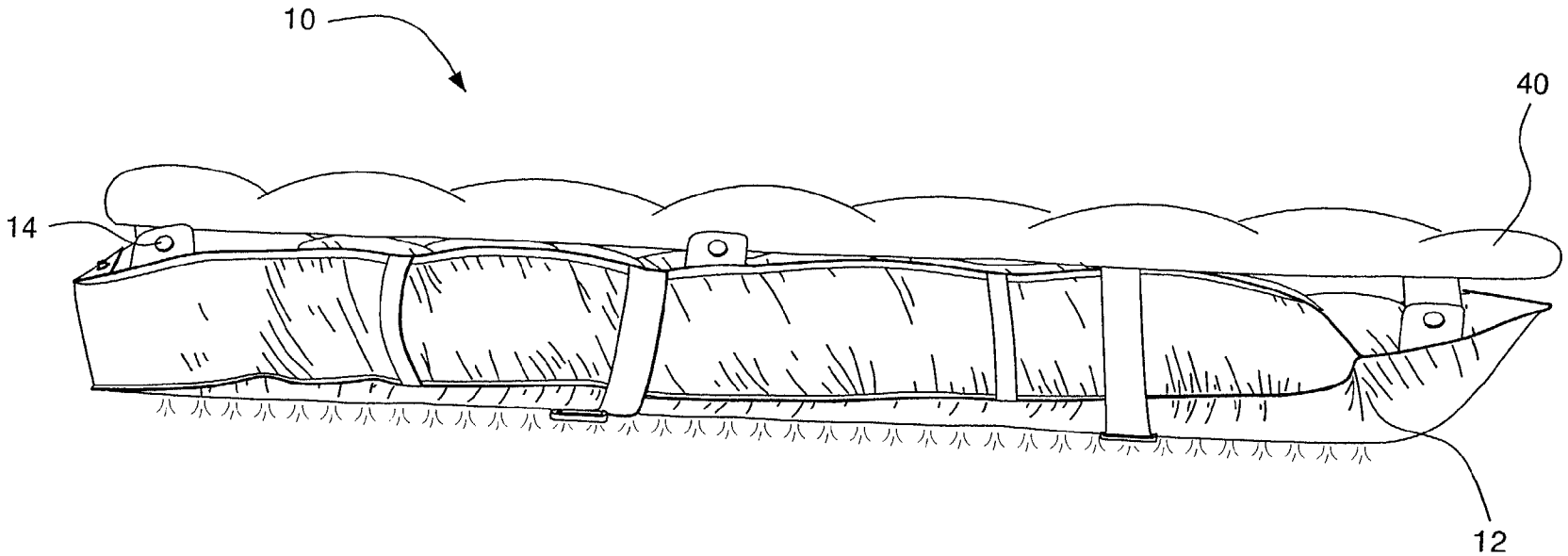
FIG. 3 is an elevation view of a patient transfer device comprising a transfer mattress adapted for transferring a patient from one surface to another with an inflatable mattress attached to the transfer mattress, in accordance with an embodiment of the invention.
Figure 10:
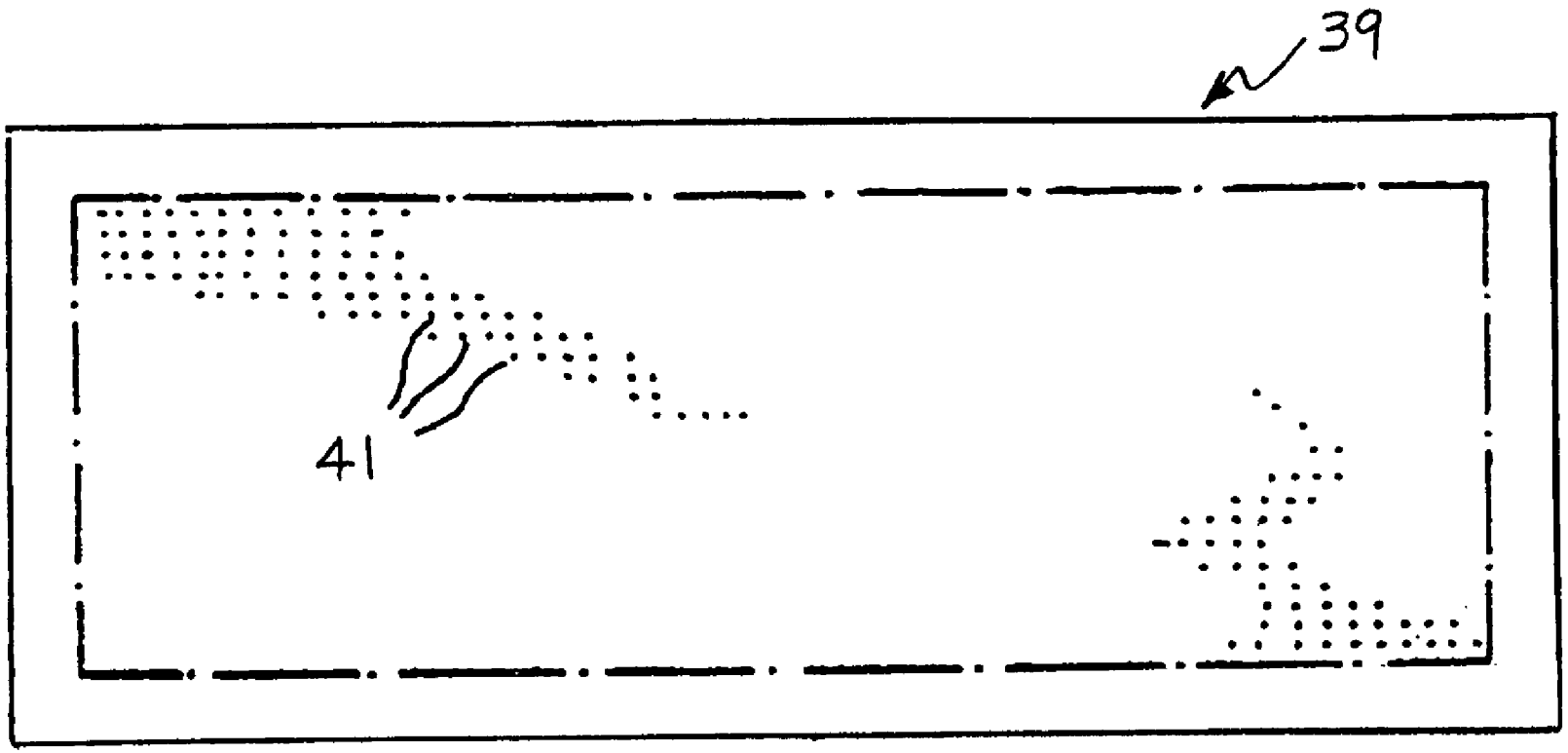
FIG. 10 is a plan view of a bottom sheet of a patient transfer mattress including a plurality of holes for creating a cushion of escaping air to facilitate sliding of the transfer mattress on a supporting surface.
Figure 11:
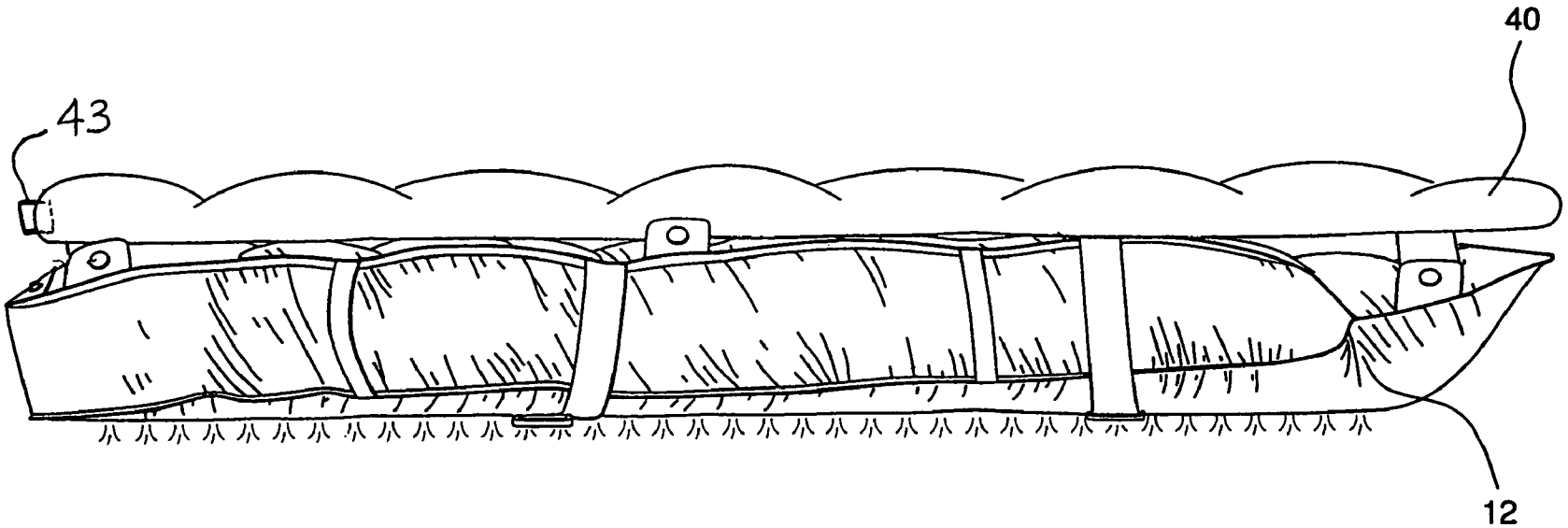
FIG. 11 is an elevation view of a patient transfer device comprising a transfer mattress and an inflatable mattress attached to the transfer mattress, the attached inflatable mattress including a pressure control valve.
Figure 12:
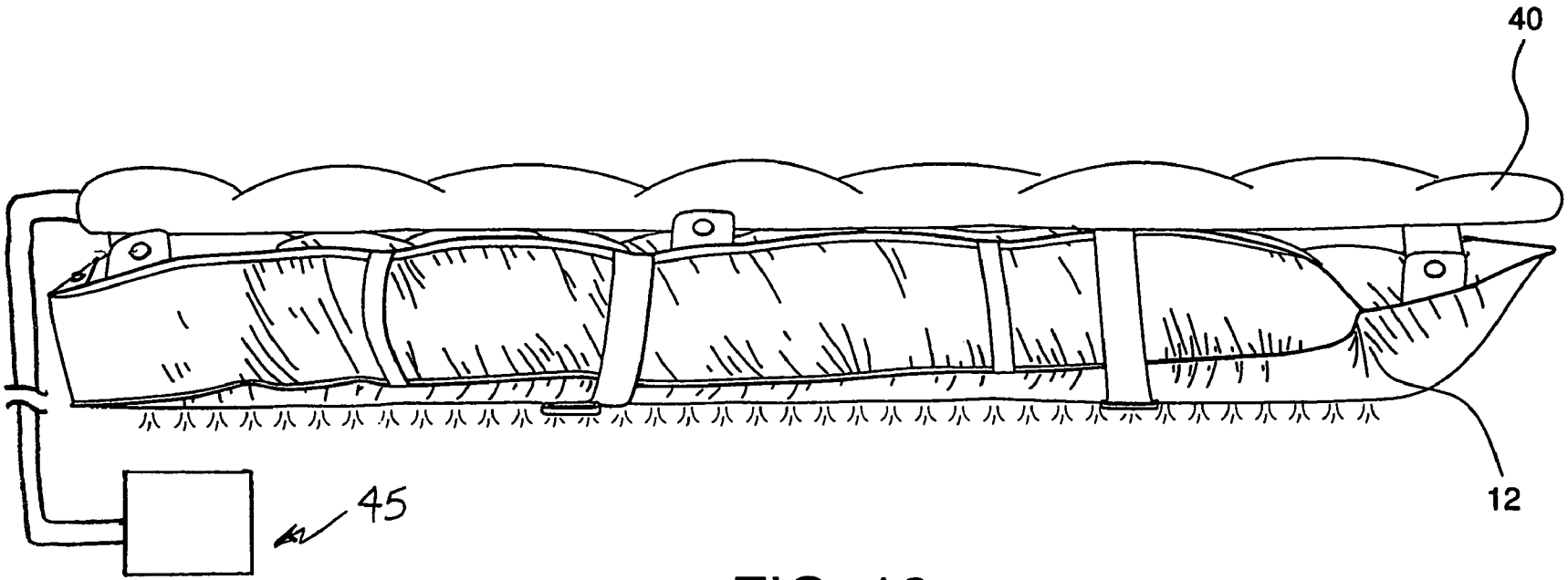
FIG. 12 is an elevation view of a transfer mattress and an attached inflatable. mattress, the attached inflatable mattress including a pulsating pressure control.
Figure 13:
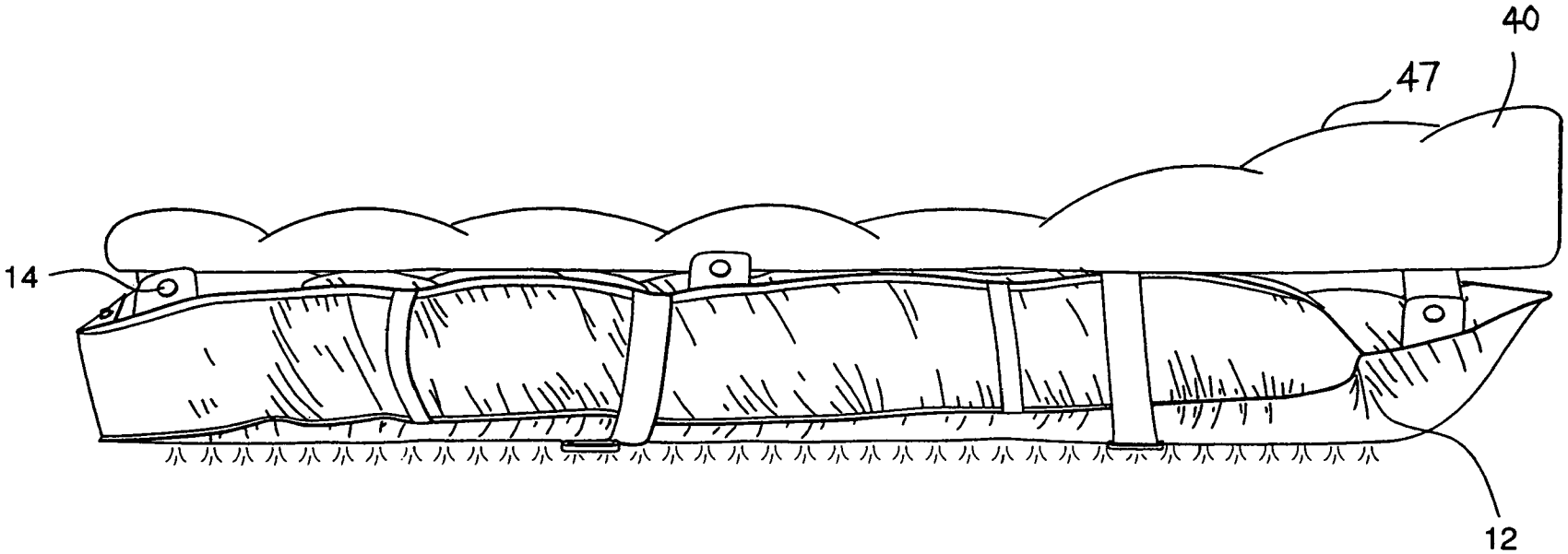
FIG. 13 is an elevation view of a transfer mattress and an attached inflatable mattress, the attached inflatable mattress including a top surface that is inclined.

In FIG. 3, an embodiment is shown in which the accessory is an inflatable mattress. In a transfer device, the transfer mattress has a bottom sheet 39 (see FIG. 10) with a pattern of tiny holes 41 to allow the escape of air supplied into the mattress by a low-pressure air supply. The air supplied to the transfer mattress escapes through the holes, providing a weight-bearing cushion to facilitate sliding the mattress along a surface as well as from one surface to another. Referring to FIGS. 11 and 12, the accessory inflatable mattress 40 may have a pressure control valve 43 or a pulsating pressure control 45. Referring to FIG. 13, the accessory inflatable mattress 40 may include a top surface 47 that is inclined so that the head of a patient lying horizontally on the mattress is at a higher point with respect to a supporting surface than the feet. The mattresses 12, 40 may be releasably attached as shown with snaps. The mattresses 12, 40 may also include at least one sheet, either top or bottom or both, that is rigid or substantially rigid to cause a surface to remain relatively level while the mattress is inflated.

In the embodiment shown in FIG. 3, it should be understood that the second mattress 40 is not limited to being an air mattress, but may be any type of mattress or pad depending on the needs of the patient. For instance, it is very common for closure of a patient's capillaries to be a concern for patients that are confined to a bed for an extended period. In such situations, any type of accessory that will prevent capillary closure may be attached to the transfer mattress 12. For example, any type of therapeutic pad, such as for example a gel pad, may be attached to the transfer mattress 12 to ensure patient comfort and reduce the risk of capillary closure. Where the mattress 40 is inflatable, however, a variable pressure air supply may be used so appropriate pressure levels may be delivered to each mattress, as desired. For example, the inflatable mattress 40 may be inflated using a lower degree of pressure than the transfer mattress 12.

Figure 4:
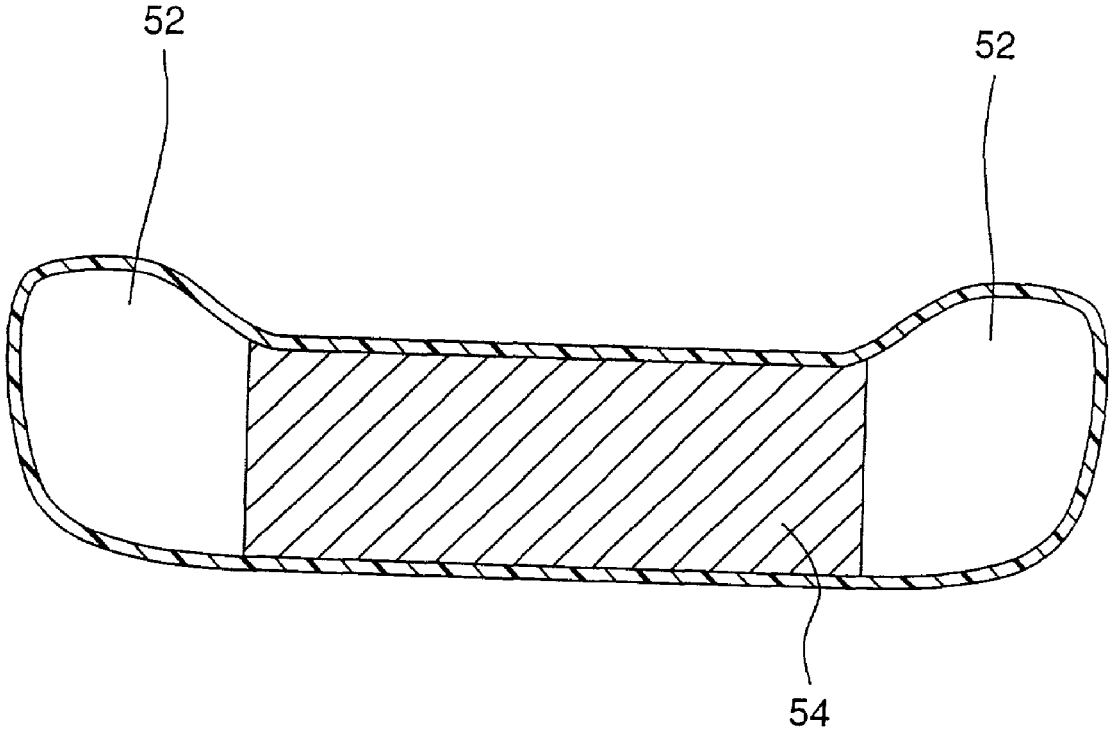
FIG. 4 is a cross-sectional view of a patient transfer device wherein a transfer mattress is adapted to assist in centrally locating a patient on the mattress and showing an interior partition to prevent the mattress from hot-dogging, in accordance with an embodiment of the invention.

The transfer and inflatable mattresses may be constructed in any shape or size. For example, the transfer mattress may be constructed so that the apex distance between top and bottom sheets, when the pads are inflated, is greater outboard of the seam than in the array of transverse chambers to bias the patient towards the center of the pad by creating the effect of an inverted pontoon at each longitudinal side of the array. FIG. 4 shows a cross-sectional view of a transfer mattress or pad constructed in that shape. This shape is especially useful for helping to center a patient on the mattress and providing additional security for the patient. The transfer mattress can also be constructed such that the plenum chamber 52 of the pontoon extend downward. Adjusting the distance of transverse partition members between top and bottom sheets causes variations in the shape of a mattress. To adjust the distance between sheets, the height of the partition 54 may be adjusted, as desired.

Figure 5:
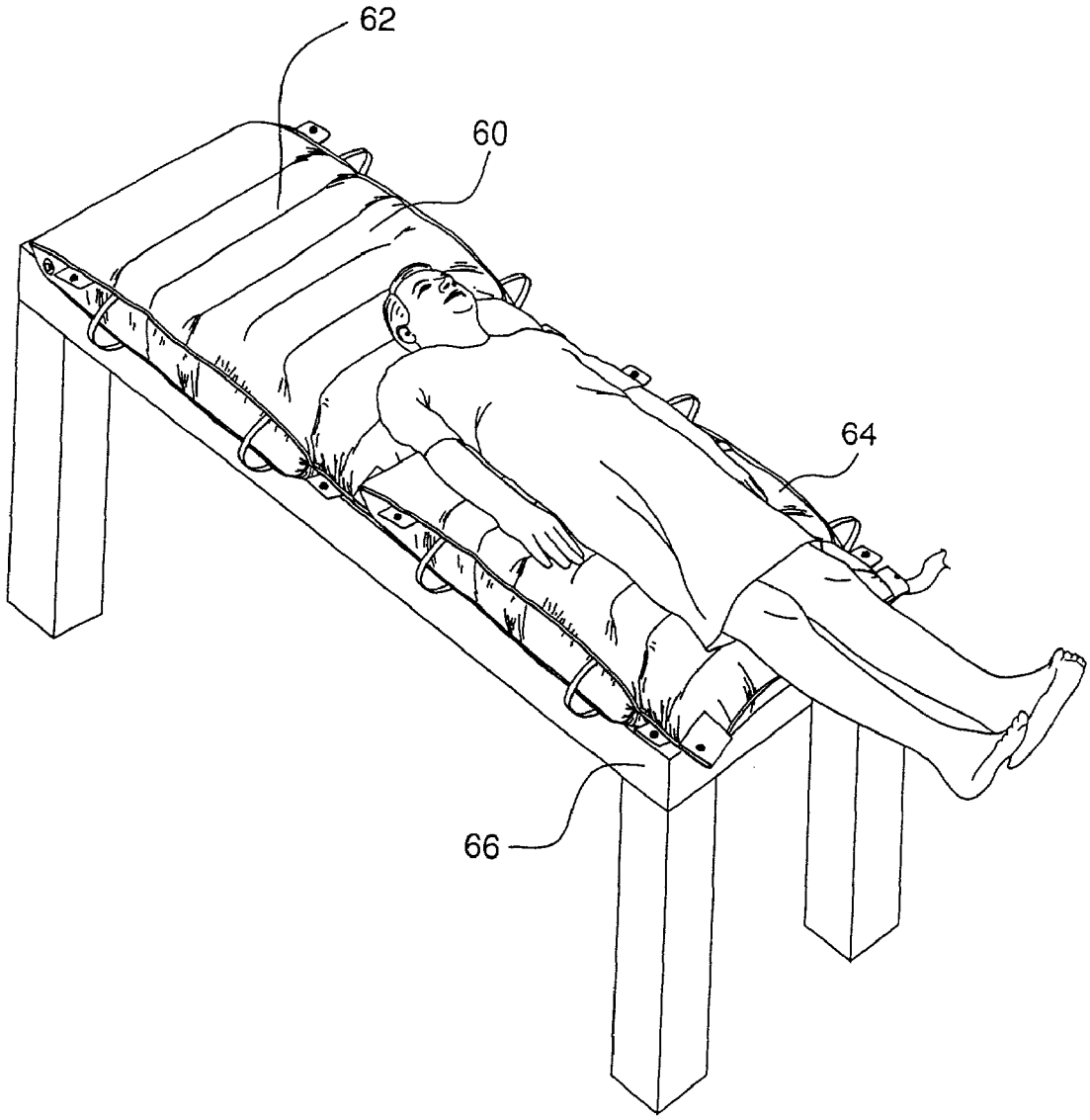
FIGS. 5 and 6 are a patient transfer device comprising a sectioned mattress formed with two inflatable pads, in accordance with an embodiment of the invention.
Figure 6:
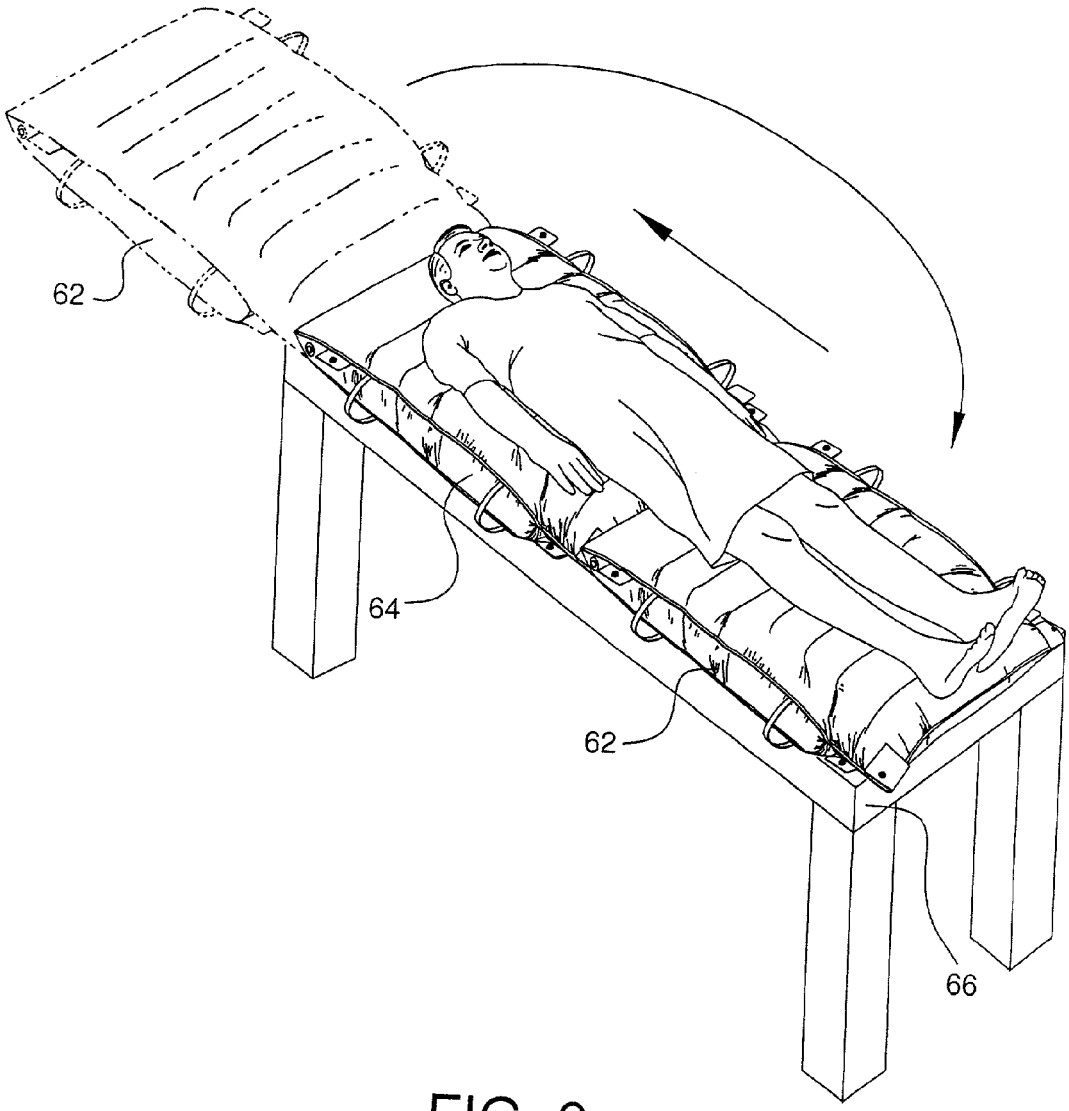

Moving to FIGS. 5 and 6, an embodiment of the patient transfer device may include a sectional mattress 60 having a plurality of inflatable pads 62, 64, at least one being a transfer pad having a bottom sheet with a pattern of tiny holes to allow the escape of air to facilitate sliding the pad from one surface to another. In this embodiment, each pad may have means for attaching to another pad to form a complete mattress 60 for a patient. The attachment means may be a snap, belt, or hook and loop fastener, for example. There may be any number of pads but the overall collective size of the pads when attached together will generally be similar in size to a typical hospital bed. In FIG. 5, the sectioned mattress 60 is shown as comprising two inflatable pads 62, 64, each less than about half the size of a typical hospital bed. The embodiment is useful because a patient laying on a hospital bed 66 will often slide down toward the foot end of the bed. In such situations, staff members typically physically pull the patient back towards the headboard. This process is often painful for the patient and a major cause of muscular skeletal disability for staff members. Having a sectioned inflatable mattress 60 comprising one or more inflatable pads 62, 64 as shown in FIG. 5 allows the patient to be re-positioned more effectively and safely, as described below.

In FIG. 5, the patient is shown partially slid downward on a hospital bed 66. The sectioned mattress 60 of the present invention is between the bed 66 and the patient. The patient can be repositioned slightly so that his upper body will be completely supported by the lower inflatable pad 64 once it is inflated. (Note, the more pads used to form the mattress 60, the less likely the patient will have to be repositioned prior to inflating the pads.)

Once the patient is in-place on pad 64, the top pad 62 may be removed. The pad 64 supporting the patient's torso is then inflated and slid upward so the patient is again properly positioned in the bed. The pad 62 is then reattached at the bottom of pad 64. The process may be repeated as necessary. Alternatively, if appropriate, after the top pad 62 is removed, it may be reattached and then inflated so that both pads 62 and 64 are used to reposition the patient as desired. Of course, the pads 62, 64 may also be inflated to move the patient from the bed to another supporting surface.

The embodiment of the invention shown in FIGS. 5 and 6 and described above, may, like other embodiments, include fasteners for attaching any type of accessory, as desired. More specifically, each pad may further include a plurality of fasteners for attaching an accessory across a top surface of a sectioned mattress formed by pads 62, 64 being attached together. The pads also include fasteners for attaching one pad to another pad and may be located on tabs that are attached to the pads at various locations, as desired.

The pads 62, 64 may include a top sheet and a bottom sheet, the top and bottom sheets being attached to each other by internal fabric strips forming a generally rectangular array of transverse air chambers supported at each longitudinal side thereof by a longitudinally-extending side air chamber. In such cases, the fasteners may generally be located outboard of the seams defined by the transition between the transverse chambers and the side chambers.

A transfer mattress, inflatable mattress, sectioned mattress, and inflatable pads, may be constructed to keep a patient level with respect to a supporting surface. When a patient is laying horizontally, the patient's torso typically imposes the greatest load on a mattress. This is of particular significance for air mattresses. If an air mattress is not constructed to properly support the patient's torso with respect to his feet and head, a patient may be forced to lay on the mattress with his feet and/or head above his torso, which is uncomfortable and could result in potentially harmful spinal flex. Therefore, it is desirable to construct the interior of an air mattress similar to what is shown in U.S. Pat. No. 5,561,873. In the '873 patent, the interior of an air mattress is constructed so that the amount of air pressure provided at various parts of the mattress correspond to the load to keep the patent substantially horizontal with respect to an underlying surface.

Figure 7A:
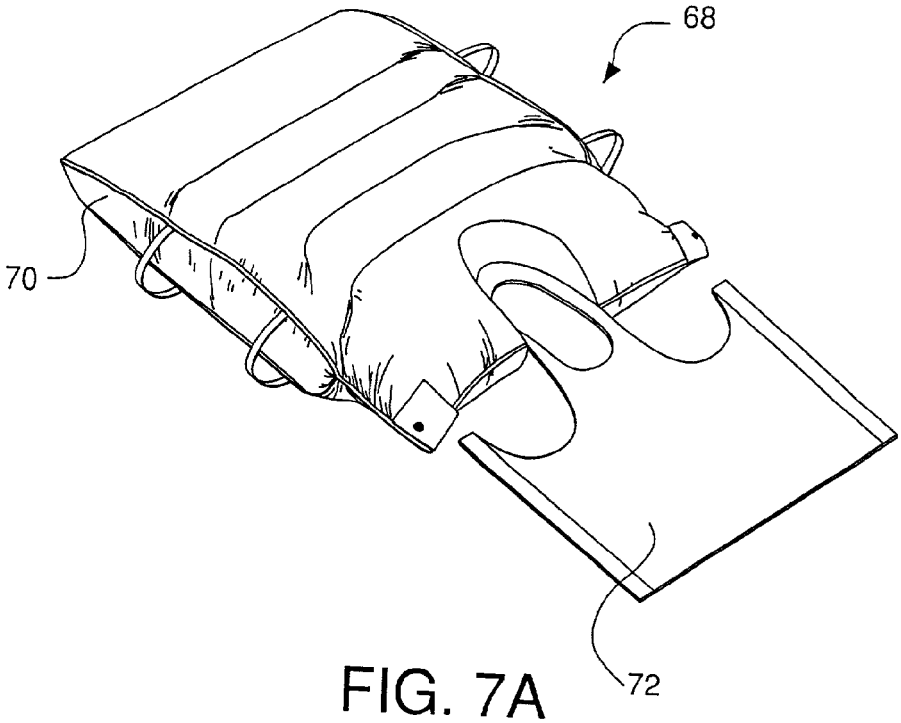
FIGS. 7A and 7B are a wearable patient transfer device comprising a transfer mattress and a garment, in accordance with an embodiment of the invention.
Figure 7B:
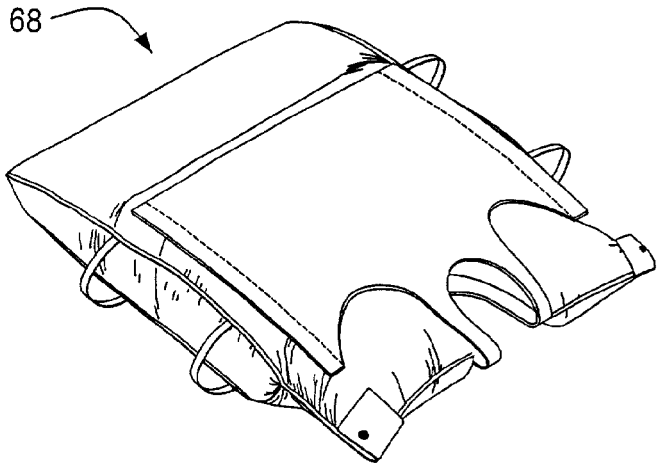
Figure 8:
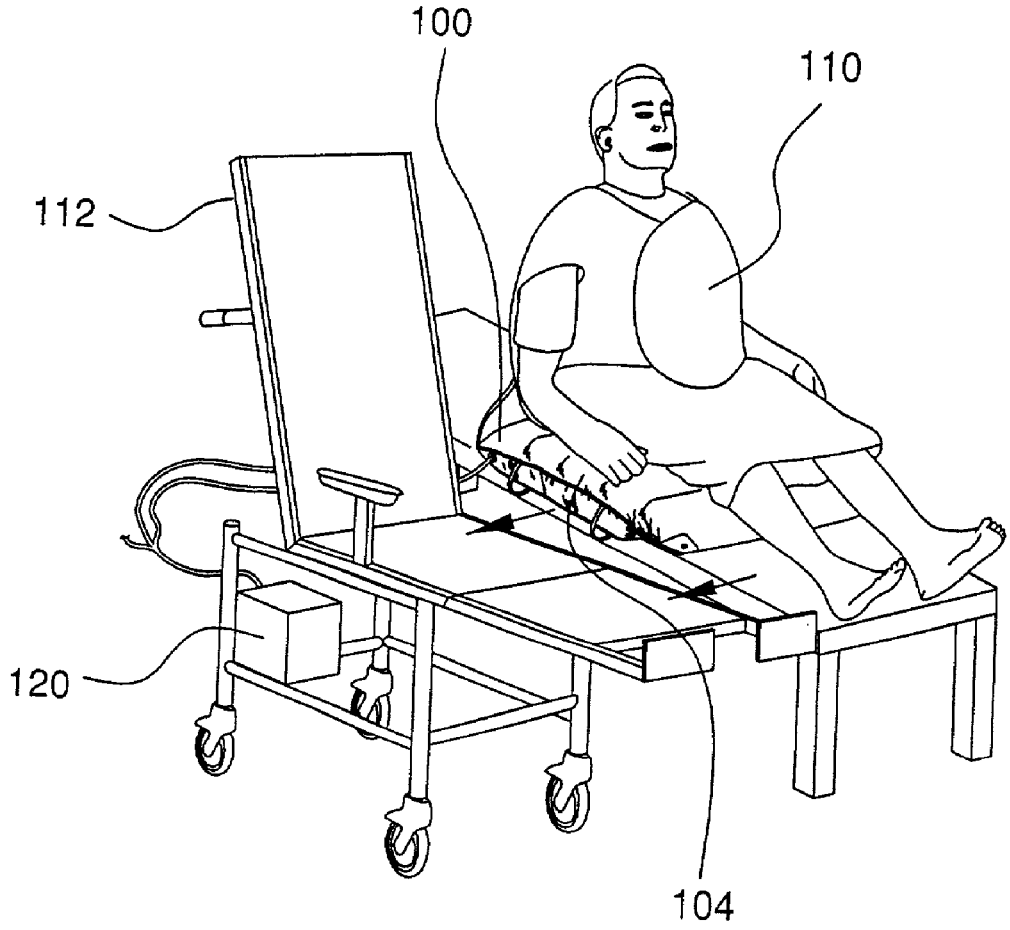
FIG. 8 is a wearable patient transfer device comprising a transfer mattress and a vest, in accordance with an embodiment of the invention.

Referring now to FIGS. 7A, 7B, and 8, embodiments of a patient transfer device 68 that patients can be attached to or worn by a patient are shown. In FIGS. 7A and 7B, the patient transfer device 68 comprises a transfer mattress 70 having a body garment 72 which allows the device 68 to be worn like a pair of shorts. The garment 72 may be any accessory capable of causing the patient to move together with the mattress 70. By way of example, a suitable accessory 68 may be a typical three-point harness used in baby products. If a patient wearing the device slides down in bed or otherwise needs to be repositioned, the mattress 70 may be inflated and the patient slid upward, safely and easily. The transfer mattress 70 preferably includes an opening to allow an attendant to position a bed pan beneath the patient, if necessary or desired.

The patient transfer device 68 is shown open is FIG. 7A and closed in FIG. 7B. Depending on the condition and preference of the patient, the device 68 may be arranged in FIG. 7A underneath a patient and attached to the patient, as desired. Alternatively, the device may be arranged as shown in FIG. 7B allowing a patient to wear the device 68 like a pair of shorts. The device 68 may be attached to a patient mattress to assist in preventing the patient from sliding down in bed.

In FIG. 8, a second wearable embodiment of patient transfer device 100 is shown. Here, the device 100 comprises a transfer mattress 104 having a wrap 110 for moving the patient together with the mattress 104. When a patient is transferred, the wrap 110 may be worn as shown, the mattress 104 inflated, and the patient transferred from the bed to, for example, a chair. The wrap 110 is attached to the mattress 104 and, in the depicted embodiment, includes openings for the arms as shown. Arm movement may be restricted, if necessary, by leaving the patient's arms inside the wrap 110 or using a wrap 110 made without arm holes. For convenience, an air supply 120 may be attached directly to a chair 112 or any object into or onto which a patient will be transferred.

Figure 9A:
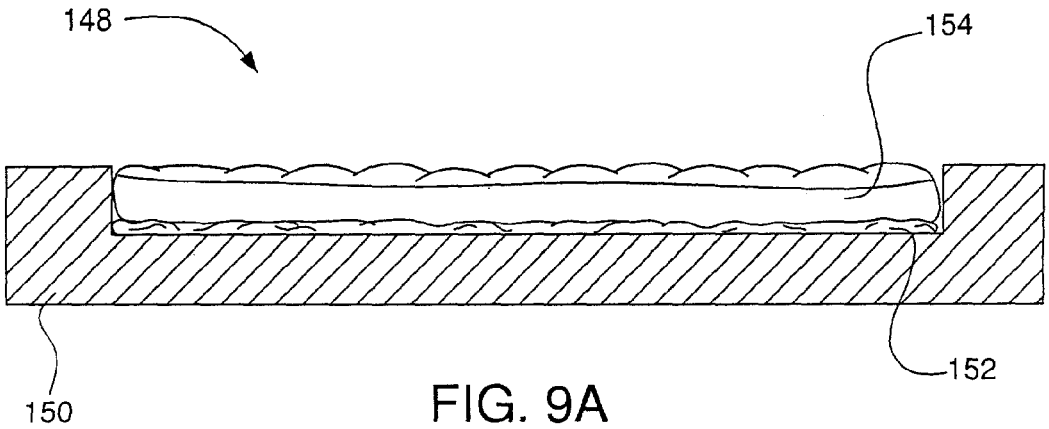
FIGS. 9A and 9B are a patient transfer device comprising a mattress having a recessed portion for receiving a patient transfer device, in accordance with an embodiment of the invention.
Figure 9B:
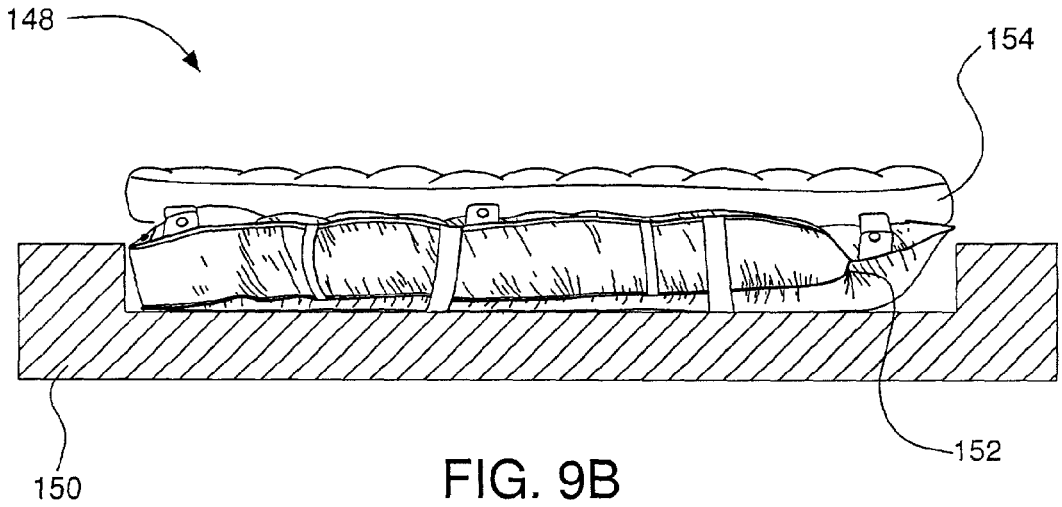

Referring now to FIGS. 9A and 9B, there is shown an embodiment of patient transfer device 148 comprising a patient mattress 150 having a recessed portion. In the depicted embodiment, the device includes a transfer mattress 152 with an inflatable mattress 154 attached to it. In FIG. 9A, the inflatable mattress 152 is deflated. The height of the inflatable mattress 154 is preferably approximately equivalent to the height of the recess. To transfer a patient, the transfer mattress 152 may be inflated as shown in FIG. 9B and transferred to another supporting surface. The width of the recessed portion may be equal to or less than the width of the patient mattress 150. Where the width of the recessed portion is less, the longitudinal edges of the mattress 150 may be removable or hingedly attached.

Each of the embodiments shown and described herein may have snaps or other fasteners allowing releasable attachment of various accessories. Although certain accessories were described in conjunction with certain mattresses, accessories and mattresses may be mixed and matched as appropriate. While certain embodiments are described as being particularly useful in performing specific movements and functions, each embodiment may be used to provide therapy, reposition a patient, or to transfer a patient from one supporting surface to another.

We claim:

1. A patient transfer device comprising:

a transfer mattress having first and second sheets, the first and second sheets defining an interior therebetween including at least one air chamber, one of the first and second sheets defining a bottom surface of the transfer mattress and including a pattern of holes for discharge of air from the at least one chamber, the discharging air facilitating sliding of the transfer mattress with respect to a surface, the interior of the transfer mattress including a generally rectangular array of transverse air chambers supported at each longitudinal side thereof by a longitudinally-extending side air chamber, the array providing for limited sagging of the torso of a person laying on the device with respect to the feet and head of the person thereby maintaining the person in a substantially parallel orientation with respect to a supporting surface for the device;

a plurality of fasteners connected to the transfer mattress, the fasteners located outboard of seams defined between the transverse chambers and the longitudinally-extending side air chambers; and an accessory releasably attached to the fasteners, the accessory extending across at least a majority of an upper surface of the transfer mattress.

2. A patient transfer device comprising:

(a) a least one inflatable transfer mattress including a plurality of holes in a bottom surface thereof for discharge of air from the transfer mattress, the inflatable transfer mattress comprising a generally rectangular array of transverse air chambers supported at each longitudinal side thereof by a longitudinally-extending side air chamber, the transition between the transverse chambers and side chambers defining a seam at each longitudinal side of the array;

(b) a plurality of fasteners for attaching an accessory across a top surface of the inflatable transfer mattress, the fasteners located outboard of the seams defined by the transition between the transverse chambers and the side chambers; and (c) an accessory selected from the group consisting of:

(i) a therapeutic pad (ii) a flexible body litter with carry handles;

(iii) a non-absorbent sanitary cover;

(iv) a washable absorbent cover;

(v) a disposable cover;

(vi) at least one cushion;

(vii) an inflatable mattress with a pressure control valve; and (viii) an inflatable mattress with pulsating pressure control.

3. A patient transfer device as claimed in claim 2, wherein the fasteners comprise snap members mounted on tabs attached to the longitudinally-extending side air chambers.

4. A patient transfer device as in claim 2, wherein the selected accessory is the at least one cushion.

5. A patient transfer device as in claim 2, further comprising means for securing a patient to the patient transfer device.

6. A patient transfer device as in claim 2, wherein the transfer mattress includes an inlet for inflating the transfer mattress comprising a valve, the valve being normally in a closed position to prevent air from exiting through the inlet.

7. A patient transfer device as in claim 2, wherein the selected accessory is an inflatable mattress with a pressure control valve, the inflatable mattress accessory including a top surface being inclined so that the head of a patient lying horizontally on the mattress is at a higher point with respect to a supporting surface than the feet of the patient.

8. A patient transfer device comprising:

a transfer mattress having first and second sheets defining at least one air chamber therebetween, one of the first and second sheets defining a bottom surface of the transfer mattress and including a pattern of holes for discharge of air from the at least one chamber, the discharging air facilitating sliding of the transfer mattress with respect to a surface; and a flexible body litter attached to the transfer mattress, the flexible body litter having carry handles.

9. A patient transfer device comprising:

(a) a transfer mattress defining top and bottom surfaces and including a pattern of holes each communicating with the bottom surface and an internal air chamber of the transfer mattress for discharge of air from the internal air chamber;

(b) a plurality of fasteners connected to the transfer mattress and adapted for attachment of an accessory across the top surface of the transfer mattress; and (c) a flexible body litter attached to the transfer mattress by the fasteners, the flexible body litter having carry handles.

10. A patient transfer device as in claim 9, wherein the flexible body litter includes flaps for covering a patient.

11. A patient transfer device comprising:

(a) a transfer mattress having a having a top sheet and a bottom sheet, the top and bottom sheets being attached to each other by internal strips forming a generally rectangular array of transverse air chambers supported at each longitudinal side thereof by a longitudinally-extending side air chamber; the transition between the transverse chambers and side chambers defining a seam at each longitudinal side of the array;

(b) the bottom sheet having a pattern of holes to allow the escape of air supplied into the transfer mattress by a low-pressure air supply, the escape of air providing a weight-bearing cushion to facilitate sliding the transfer mattress from one surface to another;

(c) a plurality of fasteners connected to the transfer mattress for attaching an accessory across a top surface of the transfer mattress; and (d) an accessory selected from the group of:

(i) a therapeutic pad (ii) a flexible body litter with carry handles;

(iii) a non-absorbent sanitary cover;

(iv) a washable absorbent cover;

(v) a disposable cover;

(vi) at least one cushion;

(vii) an inflatable mattress with a pressure control valve; and (viii) an inflatable mattress with pulsating pressure control, the accessory releasably attached to the fasteners such that the accessory is located substantially on the top surface of the transfer mattress.

12. A patient transfer device as in claim 11, wherein the fasteners are located outboard of the seams defined by the transition between the transverse chambers and the side chambers.

13. A patient transfer device as in claim 11, wherein the fasteners are mounted on tabs attached to the longitudinally-extending side air chambers.

14. A patient transfer device as in claim 11, wherein the selected accessory is the at least one cushion.

15. A patient transfer device as in claim 11, wherein at least one of the sheets is substantially rigid.

16. A patient transfer device as in claim 11, wherein the transfer mattress includes an inlet for inflating the transfer mattress comprising a valve, the valve being normally in a closed position to prevent air from exiting the transfer mattress through the inlet.

17. A patient transfer device as in claim 11, wherein the selected accessory is an inflatable mattress with a pressure control valve, the inflatable mattress comprising a top surface being inclined so that the head of a patient lying horizontally on the inflatable mattress is at a higher point with respect to a supporting surface than the feet of the patient.

18. A patient transfer device as in claim 11, wherein the selected accessory is an inflatable accessory with pulsating pressure control, the inflatable mattress accessory comprising a top surface being inclined so that the head of a patient lying horizontally on the device is at a higher point with respect to a supporting surface that the feet of the patient.

19. A patient transfer device as in claim 11, further comprising means for securing a patient to the patient transfer device.

20. A patient transfer device as in claim 11, wherein at least one of the sheets is rigid.

21. A patient transfer device comprising:

an inflatable transfer mattress having a top sheet arranged to provide load-bearing support of a patient and a bottom sheet, the bottom sheet defining a plurality of holes for discharging air to facilitate sliding of the mattress with respect to an underlying support surface; and a plurality of fasteners for attachment of an accessory, each fastener mounted on a tab connected to the mattress adjacent a periphery of the top sheet, the tabs arranged for attachment of the accessory across the top sheet of the transfer mattress.

22. In a patient transfer device as in claim 21, wherein each fastener comprises a snap member.

23. A patient transfer device comprising:

a transfer mattress having a top sheet arranged to provide load-bearing support of a patient and a bottom sheet, the bottom sheet defining a plurality of holes for discharging air to facilitate sliding of the mattress with respect to an underlying support surface, the transfer mattress including a plurality of internal strips defining a plurality of transversely-extending chambers and a pair of longitudinally-extending side chambers, the transfer mattress including a longitudinally-extending seam defined between each of the side chambers and the transverse chambers; and a plurality of fasteners each located outboard of the seams, the fasteners arranged to provide for attachment of an accessory across the top sheet of the transfer mattress.

24. A patient transfer device as in claim 23, wherein each fastener is mounted on a tab connected to the mattress adjacent a periphery of the top sheet.

* * * * *